US005341522A

United States Patent [19]

Munro

[11] Patent Number: 5,341,522

[45] Date of Patent: Aug. 30, 1994

[54] WATER CONSERVATION DEVICE FOR USE IN TOILET TANKS

[75] Inventor: James Munro, Edmonton, Canada

[73] Assignee: The Enviro Shop Corp., Canada

[21] Appl. No.: 68,892

[22] Filed: May 28, 1993

[30] Foreign Application Priority Data

Oct. 23, 1992 [CA] Canada ..... 2081293

[51] Int. Cl.[5] ..... E03D 3/12

[52] U.S. Cl. ..... 4/415; 4/324; 4/411; 4/412; 4/392

[58] Field of Search ..... 4/324, 325, 415, 385, 4/386, 378, 411, 412, 405, 414, 390, 391, 392, 393; 16/81, 194

[56] References Cited

U.S. PATENT DOCUMENTS

| | | | |
|---|---|---|---|
| 1,353,333 | 9/1920 | Gervais | 16/194 |
| 1,667,990 | 5/1928 | Rogers | 4/412 |
| 2,074,347 | 3/1937 | Steiner | 16/194 |
| 3,274,733 | 9/1966 | Bailey | 16/81 |
| 4,080,669 | 3/1978 | Biggerstaff | 4/325 |
| 4,117,556 | 10/1978 | Semler | 4/325 |
| 4,138,749 | 2/1979 | Clark | 4/324 |
| 4,216,555 | 8/1980 | Detjen | 4/324 |
| 4,651,359 | 3/1987 | Battle | 4/324 |
| 4,748,699 | 6/1988 | Stevens | 4/324 |
| 4,928,327 | 5/1990 | Kuhn | 4/324 |
| 4,945,578 | 8/1990 | Jomha et al. | 4/391 |
| 5,105,480 | 4/1992 | Howell et al. | 4/412 |
| 5,157,796 | 10/1992 | Boyer et al. | 4/392 |
| 5,195,189 | 3/1993 | Gibb | 4/325 |

FOREIGN PATENT DOCUMENTS

| | | | |
|---|---|---|---|
| 3136916 | 6/1983 | Fed. Rep. of Germany | 4/415 |

*Primary Examiner*—Henry J. Recla
*Assistant Examiner*—Charles R. Eloshway
*Attorney, Agent, or Firm*—Davis, Bujold & Streck

[57] ABSTRACT

A water conservation device for use in toilet tanks which have a valve movable between an open and a closed position. The valve is connected to a flush linkage which draws the valve to the open position upon activation of a flushing lever. The water conservation device consists of an elongate body having a first end and a second end. The first end of the elongate body is indirectly linked to the valve. The second end of the elongate body is indirectly suspended within the toilet tank, such that the elongate body is disposed at an angle to the valve. As the elongate body pivots, the weight of the elongate body pulls the valve into the closed position.

9 Claims, 3 Drawing Sheets

WATER CONSERVATION DEVICE FOR USE IN TOILET TANKS

The present invention relates to a water conservation device for use in toilet tanks.

BACKGROUND OF THE INVENTION

Toilets are constructed with bowls to receive human excrement and tanks that hold water for the purpose of clearing the excrement from the bowl. They generally have a valve movable between an open and a closed position. The valve is connected to a flush linkage which draws the valve into the open position upon activation of a flushing lever. A standpipe is provided which serves to prevent the toilet tank from overflowing. It is generally accepted that when a toilet is flushed more water is released from the tank than is required to clear the bowl.

To address the problem of excess water usage, a plurality of water conservation devices have been developed. Examples of such water conservation devices are U.S. Pat. No. 4,748,699 which issued to Charles F. Stevens in 1988 and U.S. Pat. No. 4,945,578 which issued to Mohamed A. Jomha and Andrew Lazowski in 1990. These patents disclose floatation devices which travel up and down on the standpipe of the toilet and push the valve into the closed position.

Water conservation devices which "push" the valve into a closed position have a number of inherent problems. One problem is that they are relatively complex. Another problem is that they are difficult to install on some styles of toilets. A final problem is that the valve occasionally becomes jammed in a partially open position resulting in gallons of water flowing through the tank.

SUMMARY OF THE INVENTION

What is required is a comparatively simple alternate form of water conservation device for use in toilet tanks.

According to the present invention there is provided a water conservation device for use in toilet tanks. The toilet tanks for which this device is suited have a valve movable between an open and a closed position. The valve is connected by a flush linkage which draws the valve to the open position upon activation of a flushing lever. The water conservation device is comprised of an elongate body having a first end and a second end. A first linkage means is provided for linking the first end of the elongate body to one of the valve and the flush linkage. A second linkage means is provided for suspending the second end of the elongate body within the toilet tank, such that the elongate body is disposed at an angle to the valve. The elongate body pivots about the second linkage means whereby the weight of the body pulls the valve into the closed position.

The water conservation device as described is comparatively simple to install and need not be modified to fit alternate styles of toilets. The weight of the elongate body pulls, as opposed to pushing, the valve into a closed position.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
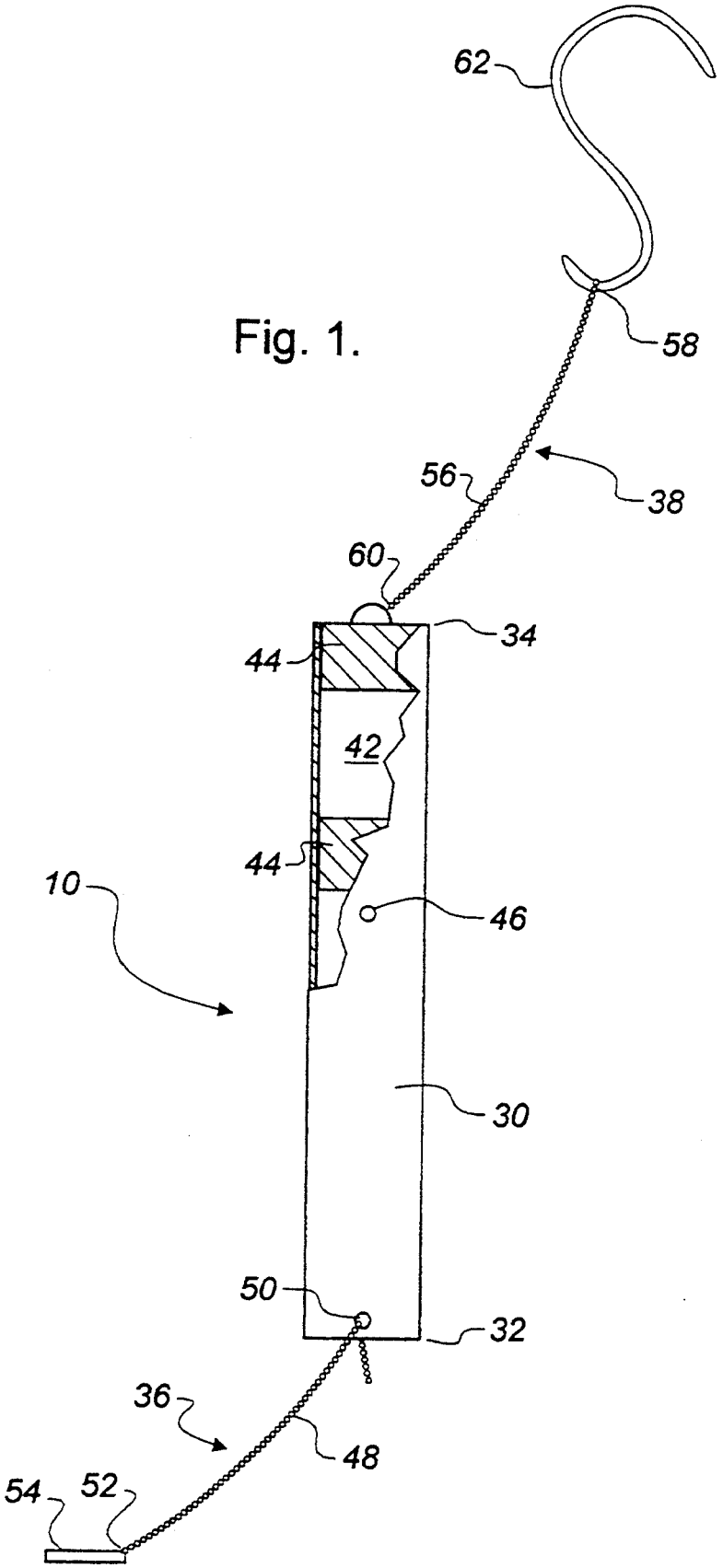
FIG. 1 is a side elevation view of a water conservation device for use in toilet tanks constructed in accordance with the teachings of the present invention.
Figure 2:
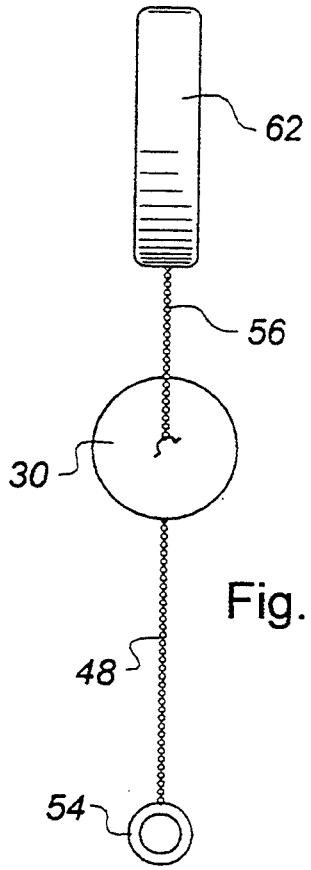
FIG. 2 is a top plan view of the water conservation device illustrated in FIG. 1.

The preferred embodiment, a water conservation device for use in toilet tanks generally identified by reference numeral 10, will now be described with reference to FIGS. 1 through 5.

Figure 3:
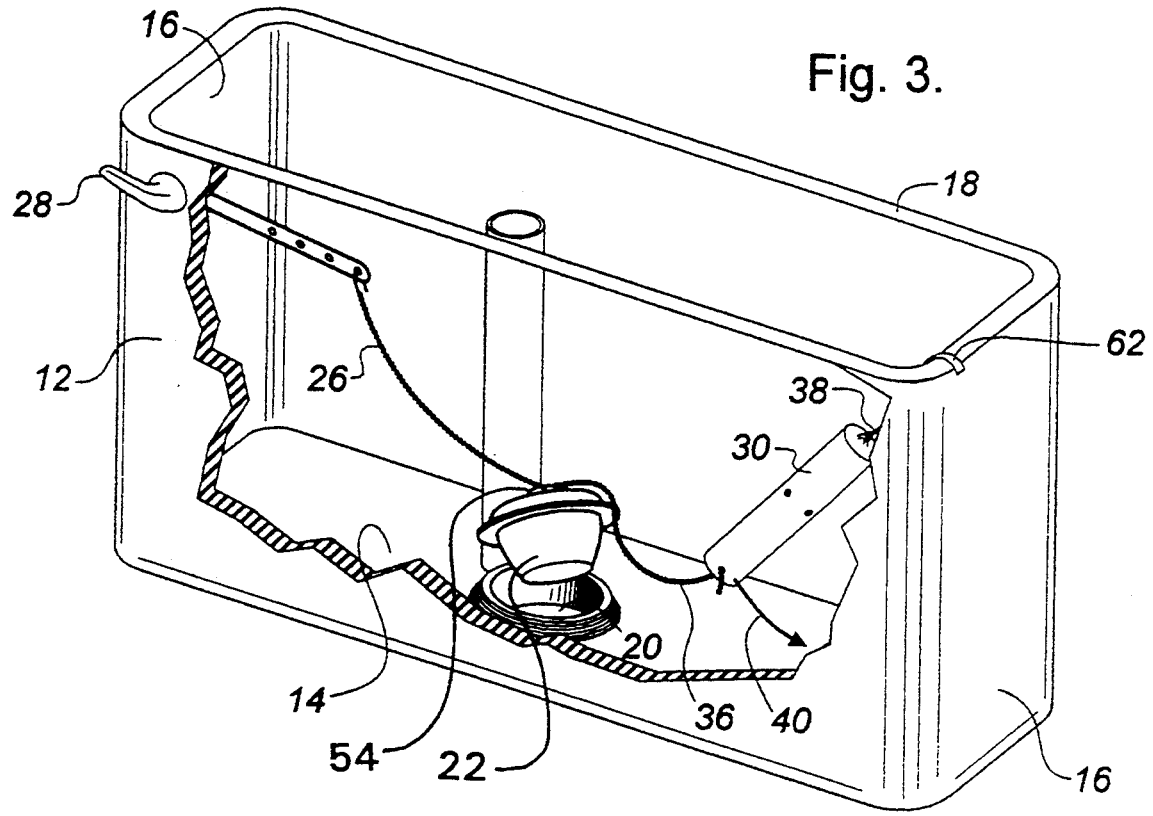
FIG. 3 is partially cut away perspective view of the water conservation device illustrated in FIG. 1 installed in a toilet tank.
Figure 4:
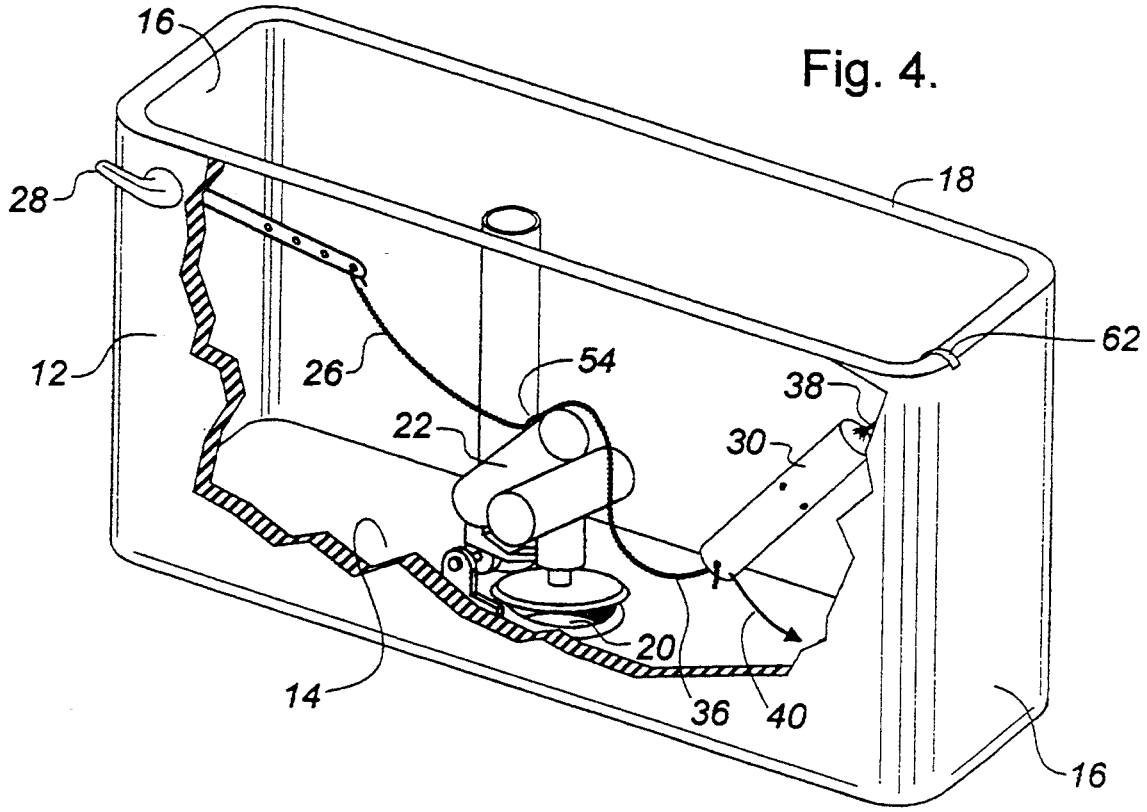
FIG. 4 is partially cut away perspective view of the water conservation device illustrated in FIG. 1 installed in a first alternative model of toilet tank.
Figure 5:
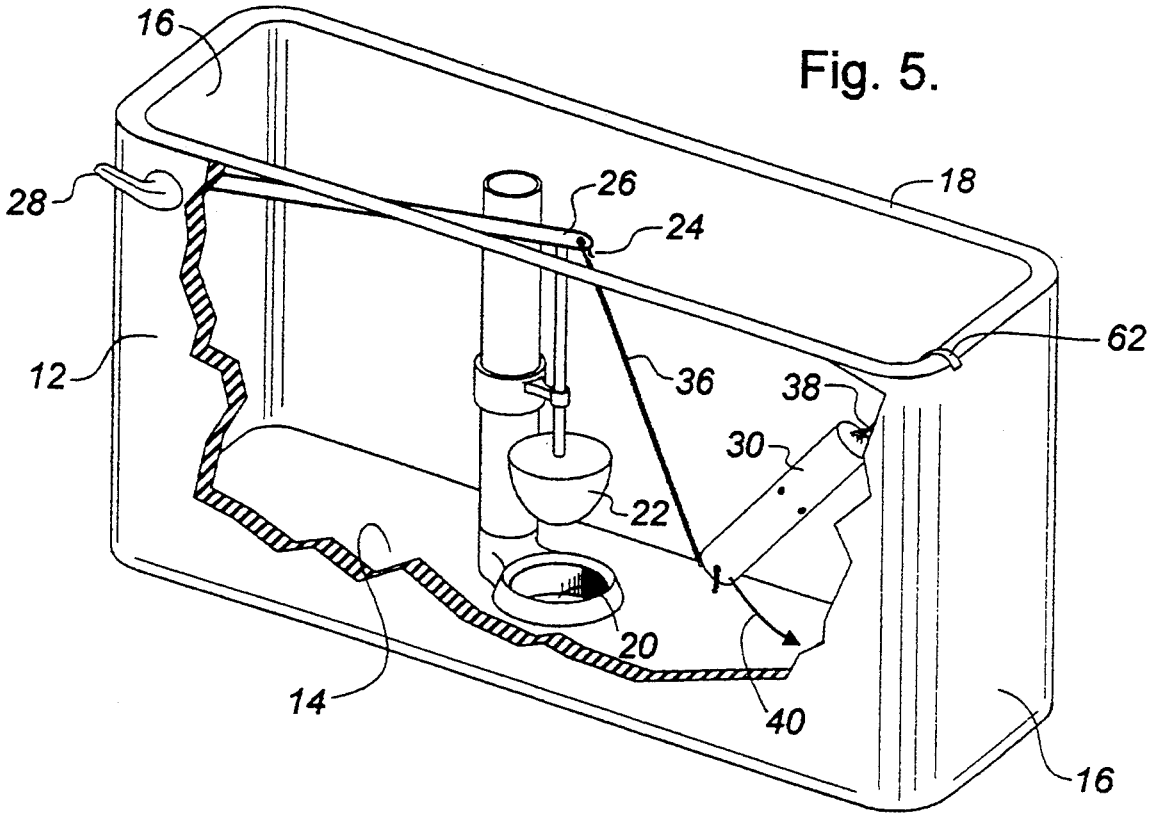
FIG. 5 is partially cut away perspective view of the water conservation device illustrated in FIG. 1 installed in a second alternative model of toilet tank.

As water conservation device 10 is intended for use in toilet tanks, there will first be described the environment into which water conservation device 10 is to be installed. Referring to FIGS. 3 through 5, there is illustrated a toilet tank generally identified by reference numeral 12. Toilet tank 12 has a bottom 14 and side walls 16 which terminate at their upper extremities in a top peripheral edge 18. There is a water flow passage 20 in bottom 14 which is controlled by a valve 22 which is movable between an open and a closed position. Valve 22 is connected by a flush linkage 26 which draws valve 22 to the open position upon activation of a flushing lever 28. It is to be noted that the structure of valve 22 and flush linkage 26 vary depending upon the manufacturer of toilet tank 12, as is clearly demonstrated by an examination of differences illustrated in FIGS. 3, 4, and 5.

Referring to FIG. 1, in its most basic form water conservation device 10 consists of an elongate body 30 having a first end 32 and a second end 34. A first linkage means 36, which will hereinafter be further described, is attached to first end 32. A second linkage means 38, which will hereinafter be further described, is attached to second end 34.

The use and operation of water conservation device 10 will now be described with reference to FIGS. 1 through 5.

Referring to FIG. 3 through 5, first linkage means 36 is used to link first end 32 of elongate body 30 to either valve 22 or flush linkage 26. In FIGS. 3 and 4, experience has shown it is easier to attach to flush linkage 26 immediately adjacent valve 22. Second linkage means 38 is attached to second end 34 and is used to suspend elongate body 30 within toilet tank 12 at an angle to valve 22. In FIG. 5, the difference in construction requires first linkage means 36 to be attached to flush linkage 26 in a position which is spaced from valve 22 in order to achieve a desired downward pulling force. Upon activation of flushing lever 28, flush linkage 26 draws valve 22 to an open position and also raises first end 32 of elongate body 30 via first linkage means 36. Elongate body 30 pivots about second linkage means 38. The weight of elongate body 30 exerts a force via first linkage means 36 pulling valve 22 back into the closed position, as indicated by arrow 40.

The refinements which are incorporated into the best mode will now be described. The selection of the materials for elongate body 30 are governed by considerations of cost and weight. Cost of production is, of course, merely a commercial consideration. Weight effects performance, as the greater the weight of elongate body 30 the more rapidly valve 22 will be pulled back into the closed position. In order to keep cost of production to a minimum tubular sections of polyvinylchloride pipe are used. Good results have been obtained through the use of tubular sections 20 cm. in length and 2.5 cm. in diameter. Tubular elongate body 30 has an interior bore 42. In order to provide additional buoyancy to elongate body 30 two corks 44 have been inserted in interior bore 42 adjacent second end 34. A plurality of apertures 46 extend transversely through elongate tubular body 30 immediately adjacent to cork inserts 44 and toward first end 32. The apertures are intended to provide a means of releasing air within interior bore 42. In the absence of apertures 46 air trapped behind corks 44 within interior bore 42 will effect buoyancy. It is preferred that first linkage means 36 consist of a first chain 48 having a first end 50 and a second end 52. First end 50 attaches to first end 32 of elongate body 30. In the models of toilet illustrated in FIGS. 3 and 4, second end 52 is secured to a ring 54 which is adapted to encircle flush linkage 26. The weight of ring 54 maintains it in position immediately adjacent valve 22. It is a much simpler alternative to attaching first chain 48 directly to valve 22. In the model of toilet illustrated in FIG. 5, a clip 24 is used. It is preferred that second linkage means 38 consist of a second chain 56 having a first end 58 and a second end 60. Second end 60 attaches to second end 34 of elongate body 30. First end 58 is secured to a hook 62 which is adapted to attach to top peripheral edge 18 of toilet tank 12. Attaching hook 62 to top peripheral edge 18 of toilet tank 12 will position elongate body 30 at an angle where its weight will tend to pull valve 22 closed. Good success has been experienced using an angle of approximately 45 degrees, although it will be recognized that there is a wide range of angles that will still permit water conservation device 10 to "pull" valve 22 closed. Where valve 22 is hinged, care must be taken to attach elongate body 30 generally opposite the hinge so that the direction of the "pull" exerted performs the intended function. There is a wide range of positions which will still permit water conservation device 10 to perform its function. Of course, water conservation device 10 will not function if elongate body 30 is positioned on the same side of valve 22 as the hinge.

It will be apparent to one skilled in the art that modifications may be made to the illustrated embodiment without departing from the spirit and scope of the invention as defined by the claims. In particular, it will be apparent to one skilled in the art that elongate body 30, first linkage means 36 and second linkage means 38 can take alternate forms.

The embodiments of the invention in which an exclusive property or privilege is claimed are defined as follows:

1. A water conservation device for use in toilet tanks which have a valve movable between an open and a closed position, the valve being connected to a flush linkage which draws the valve to the open position upon activation of a flushing lever, comprising:

a. an elongate body having a first end and a second end;

b. first linkage means for linking the first end of the elongate body to one of the valve and the flush linkage;

c. second linkage means for suspending the second end of the elongate body within the toilet tank, such that the elongate body is disposed at an angle to the valve, the elongate body pivoting about the second linkage means whereby the weight of the body pulls the valve into the closed position.

2. The water conservation device for use in toilet tanks as defined in claim 1, the elongate body being tubular.

3. The water conservation device for use in toilet tanks as defined in claim 1, the elongate body having buoyancy means disposed adjacent the second end.

4. The water conservation device for use in toilet tanks as defined in claim 1, the first linkage means being a first chain having a first end and a second end, the first end attaching to the first end of the elongate body, and the second end having means for securing to one of the flush linkage and the valve.

5. The water conservation device for use in toilet tanks as defined in claim 1, the second linkage means being a second chain having a first end and a second end, the second end attaching to the second end of the elongate body, and the first end being secured to a hook which is adapted to attach to a top peripheral edge of the toilet tank.

6. A water conservation device for use in toilet tanks which have a top peripheral edge, a valve movable between an open and a closed position, the valve being connected to a flush linkage which draws the valve to the open position upon activation of a flushing lever, comprising:

a. an elongate body having a first end and a second end;

b. a first chain having a first end and a second end, the first end attaching to the first end of the elongate body, and the second end having means for attachment to one of the flush linkage and the valve;

c. a second chain having a first end and a second end, the second end attaching to the second end of the elongate body, and the first end being secured to a hook which is adapted to attach to the top peripheral edge of the toilet tank such that the elongate body is disposed at an angle to the valve the elongate body pivoting about the hook whereby the weight of the body pulls the valve into the closed position.

7. The water conservation device for use in toilet tanks as defined in claim 6, the elongate body being tubular.

8. The water conservation device for use in toilet tanks as defined in claim 6, the elongate body having buoyancy means disposed adjacent the second end.

9. A water conservation device for use in toilet tanks which have a top peripheral edge, a valve movable between an open and a closed position, the valve being connected to flush linkage chain which draws the valve to the open position upon activation of a flushing lever, comprising:

a. an elongate tubular body having a first end, a second end and an interior bore;

b. cork inserts disposed within the interior bore adjacent the second end of the elongate tubular body thereby providing some buoyancy to the elongate tubular body;

c. a plurality of apertures extending transversely through the elongate tubular body immediately adjacent to the cork inserts and toward the first end whereby air within the interior bore is released;

d. a first chain having a first end and a second end, the first end attaching to the first end of the elongate body, and the second end being secured to a ring which is adapted to encircle the flush linkage immediately adjacent the valve;

e. a second chain having a first end and a second end, the second end attaching to the second end of the elongate body, and the first end being secured to a hook which is adapted to attach to a top peripheral edge of the toilet tank such that the elongate body is disposed at an angle to the valve and the elongate body pivots about the hook whereby the weight of the body pulls the valve into the closed position.

* * * * *